United States Patent [19]

Musgrove

[11] Patent Number: 4,527,296

[45] Date of Patent: Jul. 9, 1985

[54] SELECTIVE-FLUSH CISTERN

[75] Inventor: Neil R. Musgrove, New South Wales, Australia

[73] Assignee: James Hardie Industries Limited, New South Wales, Australia

[21] Appl. No.: 547,745

[22] Filed: Nov. 1, 1983

[30] Foreign Application Priority Data

Nov. 18, 1982 [AU] Australia ..... PF6867

[51] Int. Cl.[3] ..... E03D 1/14

[52] U.S. Cl. ..... 4/324; 4/364; 4/410; 4/413; 4/415; 4/395

[58] Field of Search ..... 4/324, 325, 364, 378, 4/392–394, 395, 405, 411–415, 410

[56] References Cited

U.S. PATENT DOCUMENTS

| | | | |
|---|---|---|---|
| 2,351,672 | 6/1944 | Engel | 4/326 |
| 3,777,316 | 12/1973 | Coetzee | 4/324 |
| 3,842,444 | 10/1974 | Gruenhagen | 4/324 |
| 4,143,430 | 3/1979 | Joshi et al. | 4/364 |
| 4,144,600 | 3/1979 | Mayes | 4/325 |
| 4,219,895 | 9/1980 | Thompson | 4/410 |

FOREIGN PATENT DOCUMENTS

| | | | |
|---|---|---|---|
| 516087 | 12/1977 | Australia . | |
| 2719910 | 11/1978 | Fed. Rep. of Germany | 4/324 |

OTHER PUBLICATIONS

Patent application 3/1980 from Australia, #AU--B-56165/80, Variable Volume Flushing Cistern.

*Primary Examiner*—Stephen Marcus
*Assistant Examiner*—Linda J. Sholl
*Attorney, Agent, or Firm*—Weingarten, Schurgin, Gagnebin & Hayes

[57] ABSTRACT

A sanitary pan flush cistern which includes structure to permit full-flush or partial flush as required. The cistern is a conventional lidded container housing usual outlet valve on a valve-rod, a press-button in the lid to open the valve and a float-controlled water admission valve. It also houses a pot which in turn houses the outlet valve, and has a normally open doorway furnished with a lid. Linkage connects both the lid and the valve-rod to the press-button so that when the latter is pressed the valve is opened and a full flush passes the outlet valve from the pot and from the outer vessel by way of the normally-open door. When the press-button is lifted the outlet valve opens as before but the door is closed so that the flush is limited to the content of the pot.

6 Claims, 9 Drawing Figures

SELECTIVE-FLUSH CISTERN

This invention relates to cisterns for the water flushing of sanitary pans. More particularly, selective-flush cisterns of the kind making provision not only for a full water flush, but also some fractional flush as the user may elect. Examples of selective-flush cisterns are those of prior Australian Pat. No. 516,087 and patent application No. 56165/80.

The cistern arrangements of the two prior items instanced above appear to be well suited for operation in the manner intended; nevertheless, they are open to objection since they are mechanically complex and they cannot easily be used in conventionally designed existing cisterns designed for single-flush only.

The object of this invention is to overcome the stated disabilities by the provision of selective-flush cistern operating mechanism which is simple yet capable of installation in an existing single-flush cistern without need for modification thereof to provide for such things as a division wall across the cistern body or the accommodation of two separate press buttons for respective operation in terms of the two modes of flush.

In summary, the invention provides selective-flush operating mechanism for a cistern of the kind comprising:

a cistern body having a bottom discharge drain and a lid having a hole in it, a closure valve normally seated on said drain, a single press-button which extends through said hole, valve-lifting means which upon said press-button being depressed cause said valve to be lifted from said drain, a float whereby said valve is held elevated once lifted and allowed to re-seat on said drain upon conclusion of a flush, and float-controlled means for water-replenishment of said body; characterised in that:

(a) said body houses an open-top partial-flush pot which contains the top aperture of said drain, said valve and said float, and has a doorway open to the inside of said body adjacent its bottom, (b) a normally open door able to close said doorway; and, (c) linkage operatively connecting said press-button with said valve and said door, such that on lifting said press-button said valve is lifted and said door is closed.

An example of the invention is illustrated, more or less schematically, in the drawings herewith.

Figure 1:
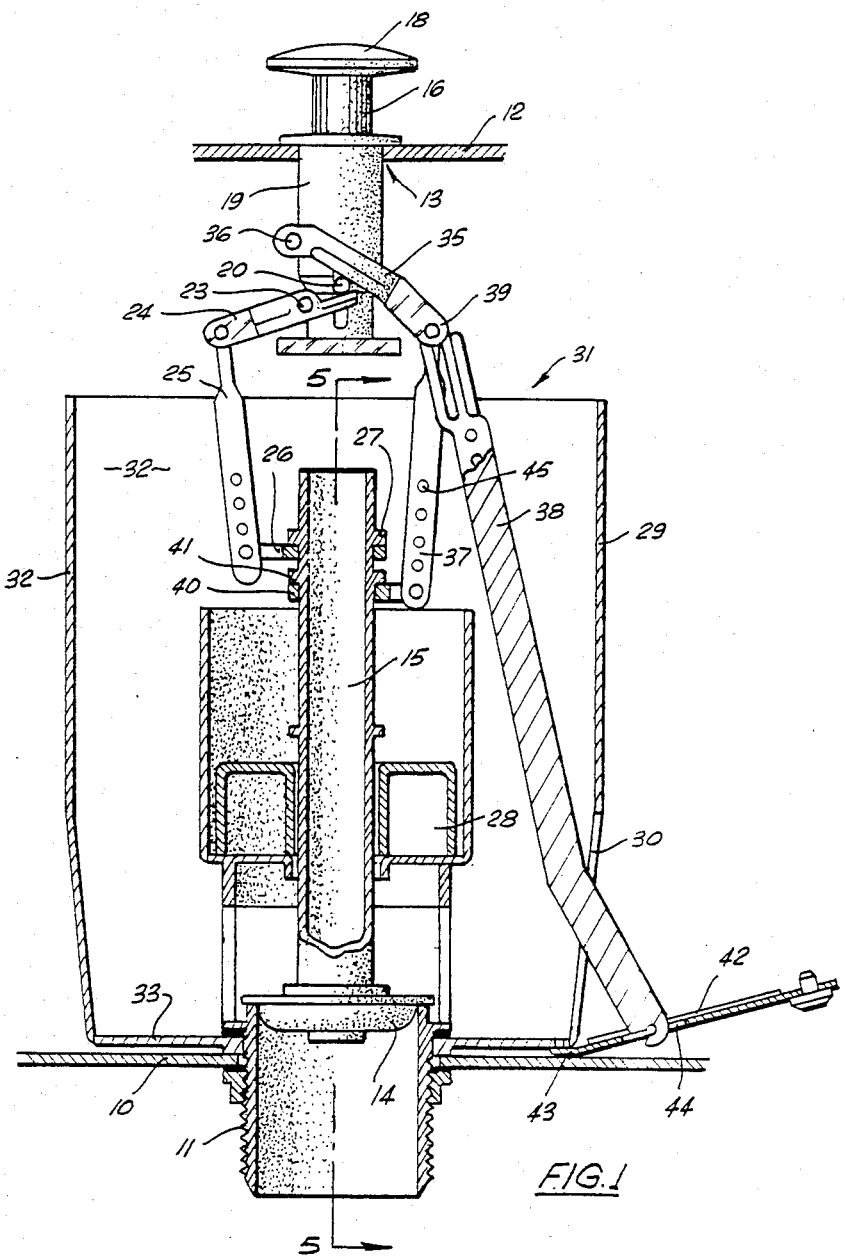
FIG. 1 is an incomplete partly-sectioned side elevation of the mentioned pot, and parts associated with it, with its door open.
Figure 2:
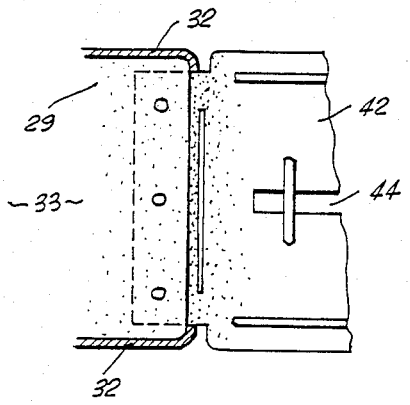
FIG. 2 is a fragmentary plan of the bottom right-hand portion of FIG. 1.
Figure 3:
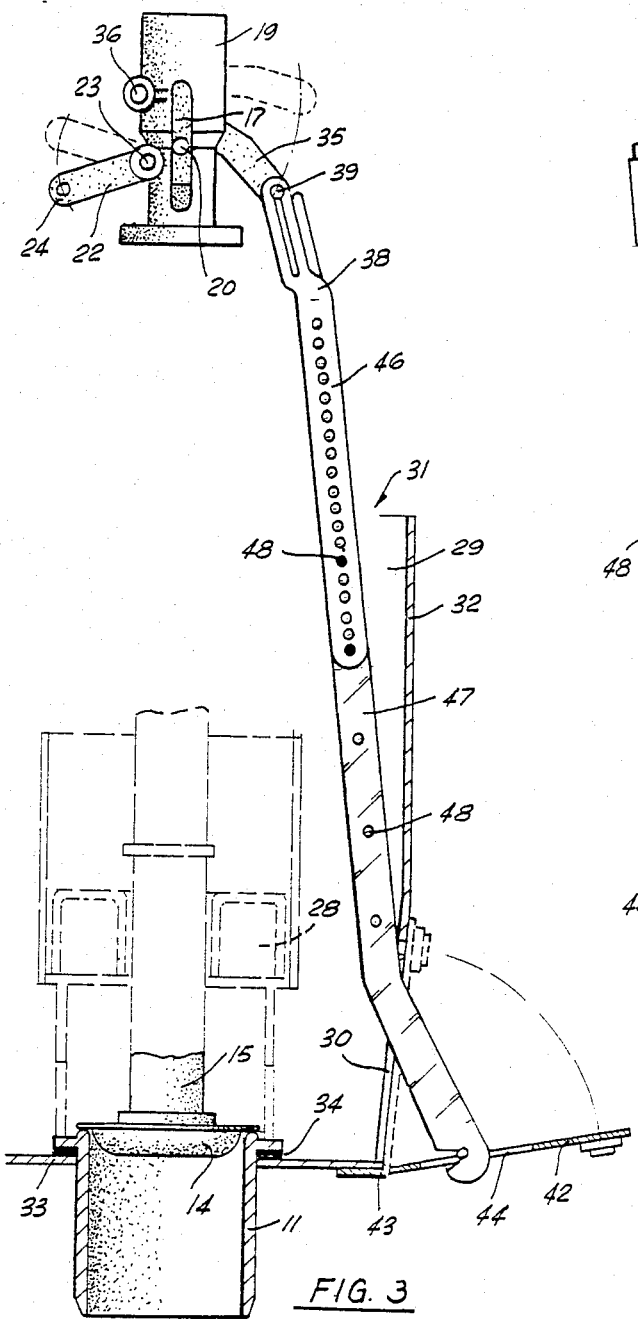

FIG. 3 largely repeats FIG. 1 to illustrate a preferred form of connector link.

Figure 4:
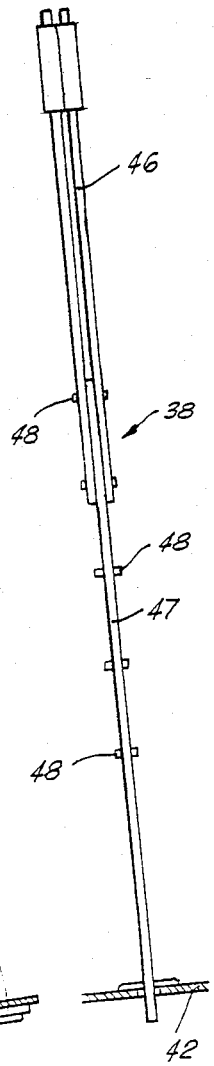

FIG. 4 is an end elevation of the connecting link shown in FIG. 3.

Figure 5:
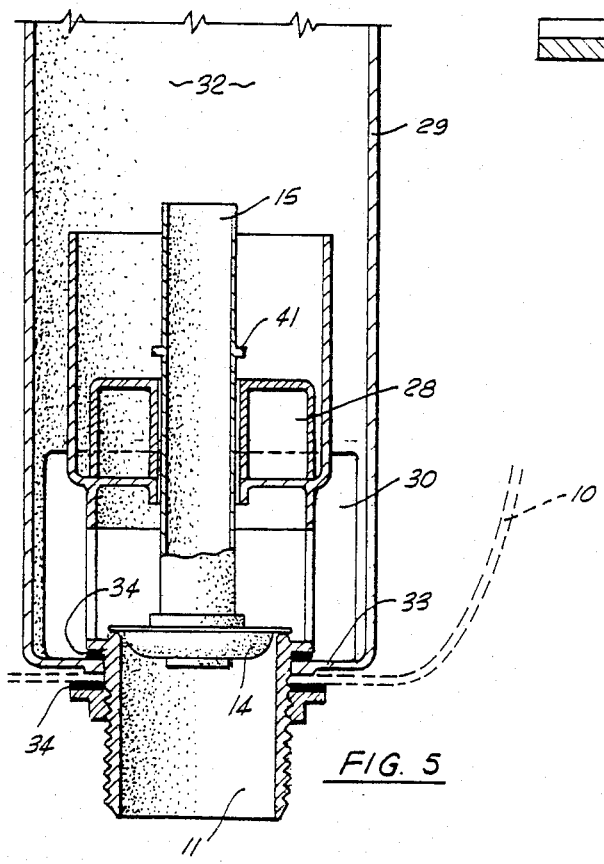

FIG. 5 is a detail of a drain shown in FIGS. 1 and 3.

Figure 6:
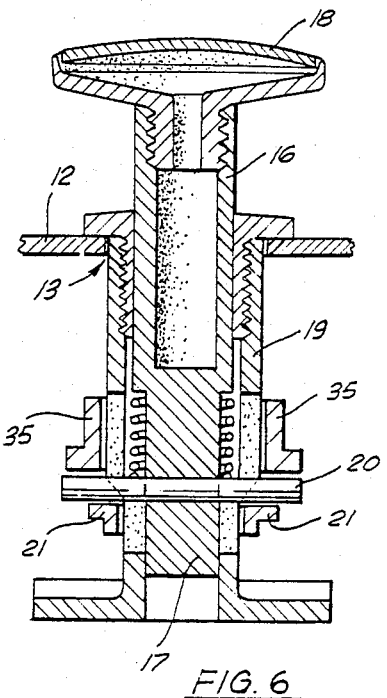

FIG. 6 is a sectional detail of a press/full button.

Figure 7:
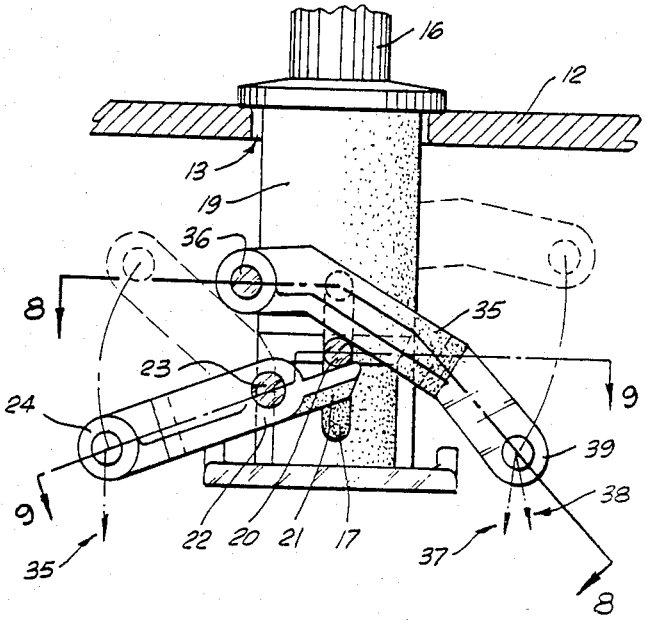

FIG. 7 repeats to top portion of FIG. 1 in a more detailed manner and on a larger scale.

Figure 9:
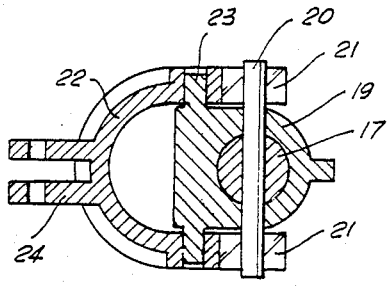
Figure 8:
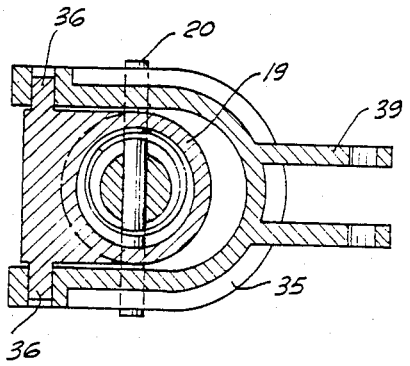

FIGS. 8 and 9 are sectional plans respectively taken on lines 8—8 and 9—9 in FIG. 7.

Referring to the drawings, a conventional cistern body 10 has a bottom drain 11 and a lid 12 having a hole 13 in it.

A closure valve 14 is normally seated on drain 11 as shown in FIGS. 1, 3 and 5. Valve 14 is mounted on the lower end of a vertically movable valve-rod 15.

A press-button 16, being the upper end portion of a stem 17, has a lifting knob 18. Stem 17 extends through hole 13, and is vertically movable in a guide tube 19. This stem (17) is preferably lightly spring loaded so that it is influenced to remain in the neutral position shown in FIGS. 1, 3, 6 and 7.

Stem 17 carries a through-pin 20 which bears upon twin arm 21 of a first stirrup lever 22 medially fulcrumed at 23. The other arm 24 of this lever is connected by link 25 to a first lifting collar 26 which loosely encircles valve-rod 15, being placed directly under a first abutment collar 27 fixed on that stem.

An inverted-cup, annular type of float, indicated at 28, is provided in conventional association with valve-rod 15. Its purpose being to hold valve 14 elevated once it has been lifted and then permit that valve to fall back into closure position (on drain 11) when the float (28) is no longer buoyed due to a flush operation nearing its end.

The cistern body 10 is, of course, provided with usual float-controlled means (not shown) whereby it is water replenished after a flush.

The arrangement, as thus far described, is largely of conventional kind and is operable in conventional manner to deliver a full flush charge. This would be effected simply by depressing button 18. This, in turn, would lower pin 20 thus to rise collar 27 and with it stem 15. The consequent lifting of valve 14 from drain 11 would initiate a full flush consisting of water contained in pot 29 (yet to be described) plus water in the body 10 passing into pot 29 through normally-open doorway 30.

When the full flush comes to an end, valve 14 re-seats on drain 11 gravitationally and the conventional float-control means operate to replenish body 10 and with it pot 29; again by way of open doorway 30.

Pot 29 has an open top 31 and consists of side walls 32 and floor 33 with a hole in it to encircle drain 11 by which the pot is held in position, as shown mainly in FIG. 5, gasket washers 34 being provided also as indicated in FIG. 5.

A second stirrup lever 35 is fulcrumed, by one end, on tube 19, at 36 and rests on through-pin 20. Lever 35 has two links 37 and 38 pivoted to its free end 39. Link 37 is connected to a second lifting collar 40 placed about stem 15 under second abutment collar 41 on that stem.

Link 38 is pivotally hooked on to a door 42 hinged on the pot 29 at 43 and able to close door 42 onto doorway 30. This closure is not absolute since door 42 has a trickle opening 44 in it. The purpose of this opening will be explained later herein.

When a fractional flush is required, the press-button 16 is lifted. This raises the free-end 39 of lever 35 thus hauling upon both of the links 37 and 38. Link 37, by lifting valve-rod 15, will open valve 14, and, at the same time, link 38 closes door 42 on doorway 30. Thus a flush takes place which is limited to the contents of pot 29 plus such small amount as may trickle into the pot through opening 43. The rate of this trickle depends on the area of opening 44. This area is selected to ensure that the in-trickle will not be enough to prevent emptying of pot 28 resulting in closure of valve 14 when the required fractional-flush has passed through it.

The height of pot 29 is not critical, since its top rim may be above or below the top level of replenishment the float-controlled means normally establish. If top 31 is below replenishment level it only means that water above the top of the pot participates in both kinds of flush; and, this may be relied upon for replenishment of pot 29 following a fractional-flush. For preference however trickle opening 44 is provided so that top water level in both pot and body will equalise irrespective of whether the top replenishment level is above or below the top rim of the pot and irrespective of whether door 42 remains closed. It will be appreciated that if a trickle opening is provided it need not be in door 42. It could be provided in a wall of the pot adjacent the pot floor.

Normally this door 42 will fall open gravitationally when free to do so, but when (after a fractional flush) the water pressure in the body is greater than that in the pot, the door will tend to keep closed, and if it should stay that way and does not have a trickle opening, further flushing could not take place until the door was opened by external means. Hence the preference for a trickle opening such as 44.

It will be appreciated that under normal operation for full flush, the door 42 will simply remain open during both flush and replenishment, and operation will go forward as though the pot 29 and the other means for fractional flush were not present.

On the other hand, during operation for fractional flush door 42 will tend to remain closed owing to external pressure, but this will be relieved by trickle flow into the pot or (if wall 32 is not too tall) by spill over open rim 31. In any case, replenishment by way of the float-controlled means, will be dependant upon the water head in the body as distinct from that in the pot since the buoyant "ball" of the float-controlled means is necessarily disposed in the body 10 but outside the pot 29.

It will be noticed that in FIG. 1 the links 24 and 37 are shown to have a number of holes therein as indicated at 45. These holes are provided to give a range of attachment points relative to lifting collars 26 and 40, thus to vary the working length of links 25 and 37 as may be necessary where selective flush means are being installed in variously sized existing cisterns. For the same reason the link 38 is preferably length adjustable as shown in FIGS. 3 and 4, where link 38 is made in two parts being a multi-holed twin portion 46 and a single-element portion 47 equipped with a series of double studs 48 for selective insertion in the holes of twin portion 46.

I claim:

1. Selective-flush operating mechanism for use with apparatus including:

a cistern body having a bottom discharge drain aperture and a lid having a hole in it, a closure valve normally seated on said drain, a single press-button extending through said hole, valve-lifting means which upon said press-button being depressed cause said closure valve to be lifted from said drain, a float whereby said closure valve is held elevated once lifted and allowed to reseat on said drain upon conclusion of a flush, and float-controlled means for water-replenishment of said cistern body; said selective-flush operating mechanism comprising:

(a) an open-top partial-flush pot included within said cistern body, said partial-flush pot containing the aperture of said drain, said closure valve and said float, and having a doorway open to the inside of said body adjacent its bottom;

(b) a normally open door able to close said doorway; and, (c) a linkage operatively connecting said press-button with said closure valve and said door, such that on lifting said press-button said valve is lifted and said door is closed.

2. Selective flush operating mechanism according to claim 1 wherein said closure valve is mounted on the lower end of a vertically movable valve-rod and wherein said linkage comprises:

a vertically movable stem on the top of which said press-button is mounted, a through-pin on said stem, a lever stationarily fulcrumed by one of its ends, and rests on said through-pin intermediately of its ends, and two links pivoted by their upper ends to the free end of said lever, said links having their lower ends respectively coupled to said valve-rod and to said door.

3. Selective flush operating mechanism according to claim 2 which includes a further link coupled to said valve-rod and forming part of said valve-lifting means, and wherein said further link and said two links are all furnished with means enabling adjustment of their working length.

4. Selective flush operating mechanism according to claim 2 which includes a second lever stationarily fulcrumed intermediately of its ends and whereof one of its ends underlies said through-pin and the other of its ends is coupled to said valve-rod.

5. Selective flush operating mechanism according to claim 1 wherein said door has a trickle opening in it.

6. Selective flush operating mechanism according to claim 1 wherein said partial-flush pot has a trickle opening formed in one of its walls adjacent its floor.

* * * * *